United States Patent [19]

Eschenbach et al.

[11] 4,437,301

[45] Mar. 20, 1984

[54] METHOD OF MAKING YARN

[75] Inventors: Paul W. Eschenbach, Moore; Andre M. Goineau, Spartanburg, both of S.C.

[73] Assignee: Milliken Research Corporation, Spartanburg, S.C.

[21] Appl. No.: 361,558

[22] Filed: Mar. 25, 1982

[51] Int. Cl.[3] ..... D02G 3/00; D02G 3/04

[52] U.S. Cl. ..... 57/289; 28/271; 57/350; 57/908

[58] Field of Search ..... 57/204, 207, 243-248, 57/288, 290, 328, 310, 350, 908, 208, 227, 228, 287, 289, 205; 28/271

[56] References Cited

U.S. PATENT DOCUMENTS

| | | | |
|---|---|---|---|
| 2,997,838 | 8/1961 | Sinski | 57/157 |
| 3,083,522 | 4/1963 | Rakowski et al. | 57/34 |
| 3,199,281 | 8/1965 | Maerov et al. | 57/908 X |
| 3,438,194 | 4/1969 | Gerutti et al. | 57/6 |
| 3,457,715 | 7/1969 | Eldridge et al. | 57/6 |
| 3,474,613 | 10/1969 | Joarder et al. | 57/34 |
| 3,517,498 | 6/1970 | Burellier et al. | 57/91 |
| 3,609,835 | 10/1971 | Boon | 28/1.4 |
| 3,640,064 | 2/1972 | Palm et al. | 57/144 |
| 3,685,268 | 8/1972 | Seguin | 57/34 |
| 3,691,750 | 9/1972 | Waters | 57/290 |
| 3,749,055 | 7/1973 | Benson | 118/234 |
| 3,812,665 | 5/1974 | Holland | 57/34 |
| 3,945,189 | 3/1976 | Allen | 57/160 |
| 3,946,468 | 3/1976 | Satterwhite | 28/271 X |
| 3,955,952 | 5/1976 | Drummond | 65/3 |
| 4,000,551 | 1/1977 | Holden | 28/72.12 |
| 4,010,601 | 3/1977 | Anahara et al. | 57/160 |
| 4,058,968 | 11/1977 | Benson . | |
| 4,080,777 | 3/1978 | Griset, Jr. | 57/140 |
| 4,145,869 | 3/1979 | Duncan et al. | 57/207 |
| 4,159,619 | 7/1979 | Griset | 57/295 |
| 4,170,865 | 10/1979 | Pike | 57/6 |
| 4,218,869 | 8/1980 | Newton | 57/351 X |
| 4,219,997 | 9/1980 | Hatcher | 57/245 |
| 4,222,223 | 9/1980 | Nelson | 57/908 X |
| 4,226,079 | 10/1980 | Mountney et al. | 57/908 X |
| 4,228,640 | 10/1980 | Talbot | 57/908 X |
| 4,248,036 | 2/1981 | Barron | 57/227 |

*Primary Examiner*—Donald Watkins

*Attorney, Agent, or Firm*—Earle R. Marden; H. William Petry

[57] ABSTRACT

Method to produce an entangled yarn product by air entangling a drawn core yarn and a drawn effect yarn. The effect yarn draw ratio is higher than the core yarn draw ratio which results in a composite yarn in which the birefringence of the core yarn is greater than that of the effect yarn.

3 Claims, 1 Drawing Figure

METHOD OF MAKING YARN

Figure 1:
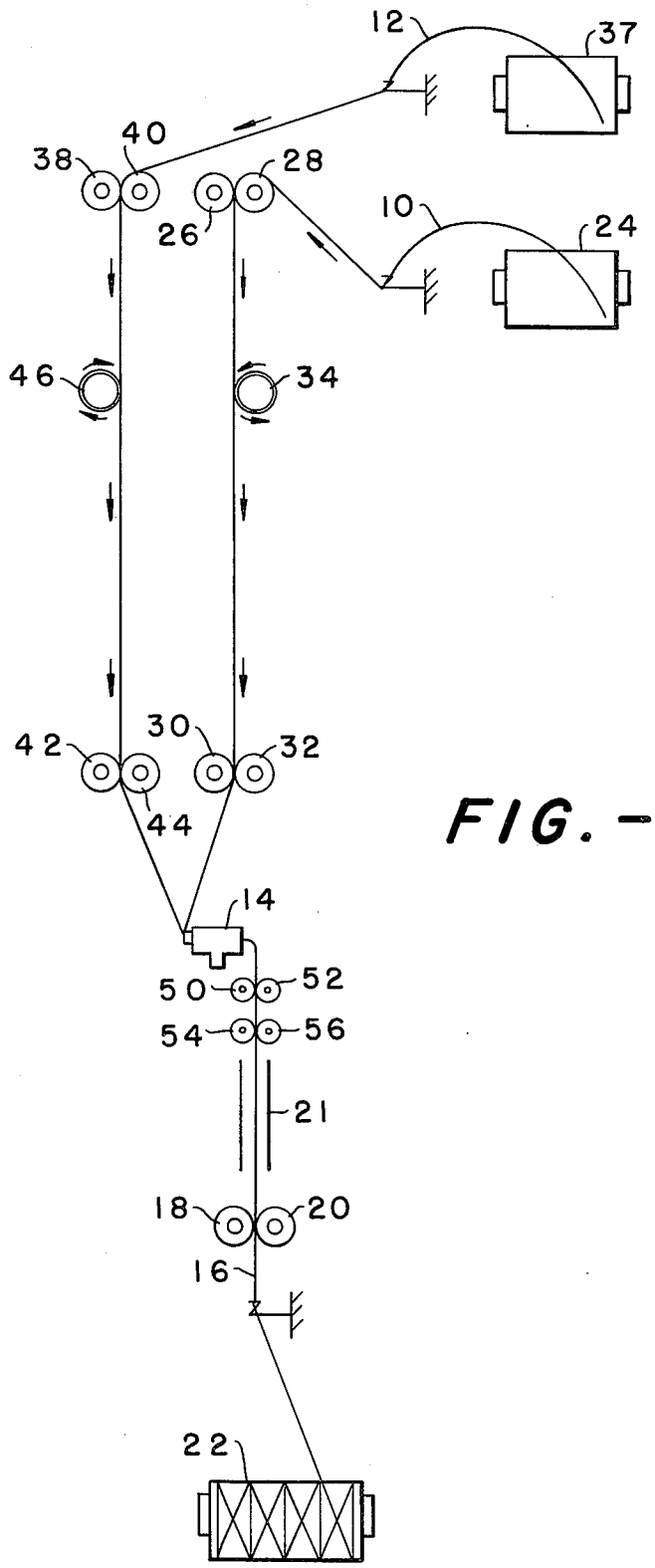

This invention relates generally to yarns produced by combining at least two yarns in an air jet to produce a continuous, multi-filament textured, spun-like yarn which will efficiently dye when made into a fabric.

It is therefore an object of the invention to provide a novel method to produce a multi-filament yarn which will eliminate a speckled effect in a fabric produced therefrom when dyed a solid color.

Other objects and advantages of the invention will become readily apparent as the specification proceeds to describe the invention with reference to the accompanying drawing, in which:

FIG. 1 is a schematic representation of the apparatus and method to produce the novel yarn.

Looking now to the drawing, there is shown one embodiment of an apparatus for producing the novel yarn composed of a core yarn and an effect yarn. In the preferred form of the invention, both the core yarn 10 and the effect yarn 12 are continuous, multi-filament, partially oriented synthetic yarns.

The core and effect yarns 10 and 12 are combined in the air jet 14 to produce the textured yarn 16 which is delivered by the take-up nip rolls 18 and 20 through the secondary heater 21 to the take-up roll 22. The core yarn 10 is delivered from the package 24 by the first delivery rolls 26 and 28 to the second delivery rolls 30 and 32 to draw the core yarn 10 after it passes over the pin heater 34 prior to delivery into the air jet 14.

The effect yarn 12 is delivered from the package 37 to the first delivery rolls 38 and 40 and is drawn by the second delivery rolls 42 and 44 after it passes over the pin heater 46. From the delivery rolls 42 and 44, the effect yarn 12 is delivered to the air jet 14.

In the preferred form of the invention two sets of nip rolls 50, 52 and 54, 56 are employed to provide a stabilizing zone therebetween prior to the supplying of the composite yarn to the take-up 22.

The speeds of the delivery rolls are pre-selected to provide a desired result in the yarn produced. In the preferred form of the invention, the speed of the rolls 26, 28, 38 and 40 is so selected that the speed of the effect yarn 12 being delivered thereby is less than the speed of the core yarn 10. The speeds of the delivery rolls 30, 32, 42 and 44 are so selected that the delivery speed of the effect yarn 12 is greater than the speed of the core yarn 10. In the preferred form of the invention, since partially oriented yarn is being run, the speeds of rolls 30, 32, 42 and 44 are so selected to draw the effect and core yarns. The speed of the delivery rolls 18 and 20 is so selected that the yarn 16 delivered therefrom is at a speed lower than the speed of either the core yarn 10 or the effect yarn 12, respectively, from the rolls 30 and 32 or 42 and 44, but greater than the speed of the yarn delivered by the rolls 38 and 40 or 26 and 28.

In operation the higher speed, overfed effect yarn 12 forms crunodal loops in the air jet 14 which project through and intermingle with the core yarn 10 and are twisted to hold the filaments of the composite yarn together to provide a spun-like yarn. It has been found that the best effort is achieved when the air pressure supplied to the jet is 100 psig or greater. "P" should be equal to or greater than 100 psig when the yarn denier is 300 or less.

An exceptionally attractive spun-like yarn is achieved when the draw ratios of the core and effect yarn are different. This is accentuated when the draw ratio of the lower speed core yarn is less than the draw ratio of the higher speed effect yarn. Preferably the core yarn draw ratio is approximately 10% greater than the draw ratio for the effect yarn. It has been found that yarn produced in accordance with this difference in draw ratio eliminates the "measle" or speckled effect produced when dyeing fabric woven or knitted from yarn made without this draw ratio differential.

It has been found that the core yarn birefringence is greater than the effect yarn birefringence when the core yarn draw ratio is less than the effect yarn draw ratio. For the sake of this description, birefringence is defined as the difference in refractive index for light polarized perpendicular to the fiber axis and for light polarized parallel to fiber axis.

The air jet 14 is a commercially available type and does not, per se, form a part of the invention other than it accomplishes the desired result of entangling and texturing the yarn.

The following is an example of the production of a yarn in the manner hereinbefore described.

EXAMPLE

The effect and core yarns are 255 denier, 68 filament, DuPont 56T partially oriented polyester yarns. The resultant combined yarn is 330 denier polyester yarn.

The combined yarn is formed under the following parameters:

Effect yarn velocity from first delivery rolls—256 meters/minute
Core yarn velocity from first delivery rolls—263 meters/minute
Pin heater 34 temperature—135° C.
Effect yarn velocity from second delivery rolls—472 meters/minute
Core yarn velocity from second delivery rolls—434 meters/minute
Draw ratio effect yarn—1.844
Draw ratio core yarn—1.65
Jet air pressure—140 psig
Pin heater 46 temperature—135° C.
Yarn velocity from jet to rolls 50, 52—406 meters/minute
Yarn velocity from stabilizing zone—412 meters/minute
Combined yarn velocity to take-up rolls—408 meters/-minute
Secondary heater 21—off
Combined yarn take-up velocity—400 meters/minute It is obvious that an air textured spun-like yarn has been provided by efficiently combining a drawn core yarn of high birefringence and a drawn effect yarn with a lower birefringence in an apparatus which employs air under pressure to commingle and texture the filaments of the core and effect yarns and which operate at an increased efficiency to produce a better yarn product. The yarn produced by the disclosed method when made into fabric does not have a "measle" or speckled appearance when dyed in solid colors. It has been found that having the draw ratio of the core yarn less than the draw ratio of the effect yarn provides the desired dye effect in solid color fabrics.

Although the preferred embodiment of the invention has been described specifically, it is contemplated that many changes may be made without departing from the scope or spirit of the invention, and we desire to be limited only by the claims.

We claim:

1. The method of producing an entangled, composite, multifilament synthetic yarn comprising the steps of: supplying a multifilament, partially oriented, synthetic core yarn and a multifilament, partially oriented, synthetic effect yarn, heating both the core and effect yarns, drawing the core yarn after heating, drawing the effect yarn after heating at a draw ratio greater than the draw ratio of the core yarn, supplying the drawn effect yarn directly without texturing to an air jet at a first rate, supplying the drawn core yarn directly without texturing to the air jet at a second rate, entangling the untextured core and effect yarns in the air jet and taking up the commingled yarn from the air jet.

2. The method of claim 1 wherein the second rate is lower than the first rate.

3. The method of claim 2 wherein the draw ratio of the effect yarn is at least 10% greater than the draw ratio of the core yarn.

* * * * *